United States Patent [19]

Gilpin

[11] 3,983,676

[45] Oct. 5, 1976

[54] APPARATUS FOR AUTOMATICALLY APPLYING AND SECURING ROOFING PANELS TO THE PURLINS OF A BUILDING

[76] Inventor: Samuel E. Gilpin, P.O. Box 36, Bardstown, Ky. 40004

[22] Filed: Apr. 7, 1975

[21] Appl. No.: 565,464

[52] U.S. Cl. ..... 52/749; 144/32 R

[51] Int. Cl.[2] ..... E04D 15/00

[58] Field of Search ..... 52/748, 749, 747; 227/100, 101, 7; 144/32

[56] References Cited

UNITED STATES PATENTS

| | | | |
|---|---|---|---|
| 3,122,862 | 3/1964 | Figge | 52/748 |
| 3,245,192 | 4/1966 | Hilson | 52/748 X |
| 3,601,168 | 8/1971 | Fernström | 144/32 |
| 3,601,947 | 8/1971 | Hurd | 52/748 X |

*Primary Examiner*—Price C. Faw, Jr.
*Assistant Examiner*—Carl D. Friedman

[57] ABSTRACT

An apparatus for automatically applying roofing panels to the purlins of a steel frame building is described. A wheeled cart containing a plurality of roofing panels rolls longitudinally of the purlins of the building and automatically deposits roofing panels on the purlins. An automatic fastening device is provided to secure the panels to the purlins in synchronism with the deposit thereof on the purlins.

7 Claims, 10 Drawing Figures

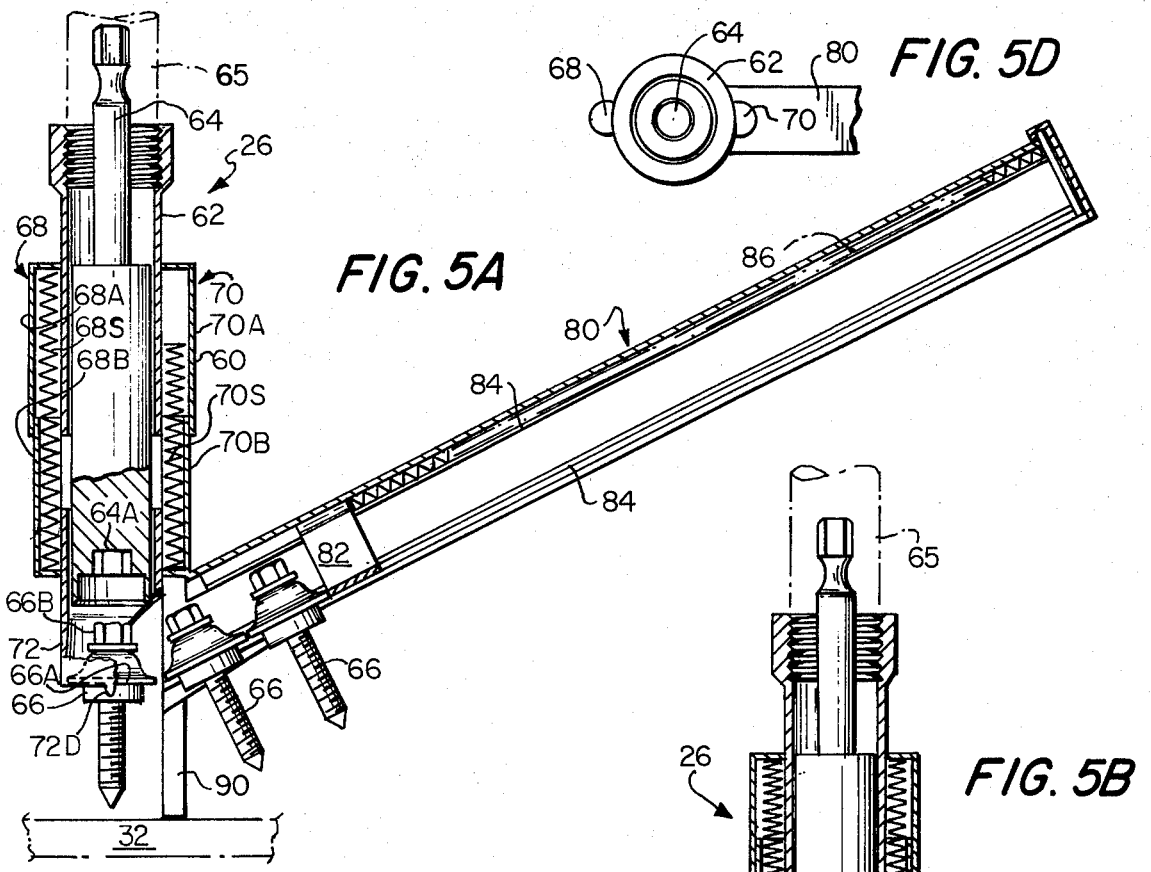
FIG. 5A
FIG. 5D
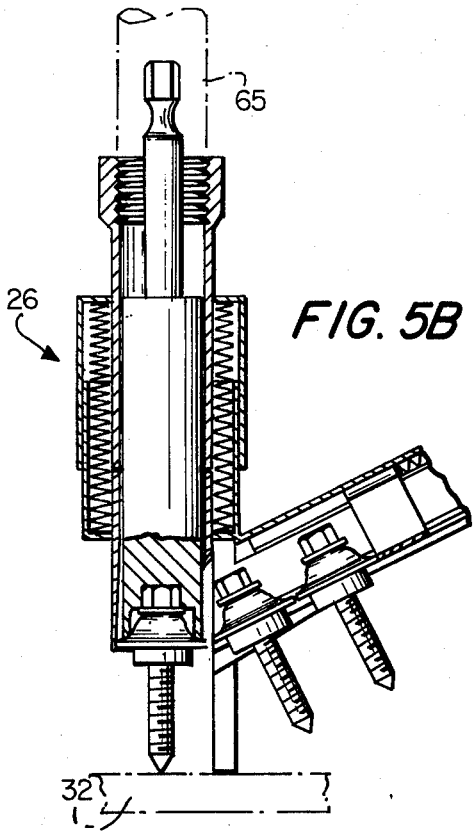
FIG. 5B
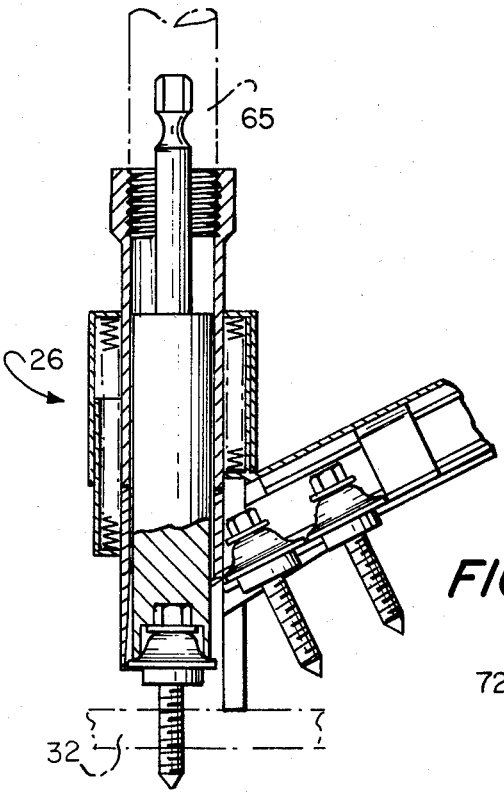
FIG. 5C
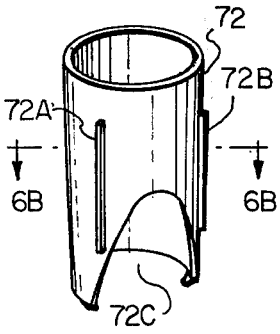
FIG. 6A
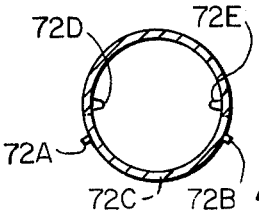
FIG. 6B

APPARATUS FOR AUTOMATICALLY APPLYING AND SECURING ROOFING PANELS TO THE PURLINS OF A BUILDING

BACKGROUND OF INVENTION

1. Field of Invention

The present invention relates to an apparatus for automatically applying and securing roofing panels to the frame of a building. More specifically the present invention relates to an apparatus for automatically depositing roofing panels on the purlins of a steel frame building and a device for synchronously fastening the panels to the purlins as the panels are deposited thereon.

2. Description of Prior Art

Heretofore roofing panels have in general been manually applied to the beams or purlins of a roof. Not only is this a time consuming and inefficient process, it is quite costly because of the high cost of manual labor.

Some machines have been conceived to attempt to automate the application of roofing materials. However, these machines require an extensive amount of supervision in their operation and in most cases are not completely automated. These machines also do not supply roofing materials at a sufficient speed to justify the cost of the machine vs. the cost of manual labor.

Other roofing machines are known which automatically feed or supply roofing panels onto the roof. However, manual labor is still required to fasten the panels to the roof.

SUMMARY OF INVENTION

Accordingly, it is a primary object of the present invention to provide a fully automated roofing machine.

It is another object of the present invention to provide a roofing machine which is fast and efficient in its operation.

It is still another object of the present invention to provide a roofing machine wherein the fastening of the roofing panels to the roof structure is fully automated.

The objects of the present invention are fulfilled by providing one or more wheeled carts which are adapted to roll along a set of parallel roof purlins. The wheeled carts contain a plurality of roofing sheets or panels and means are provided for feeding these panels or sheets onto the roof purlins as the carts travel longitudinally of the purlins.

A fastening means is provided for automatically fastening the roofing panels to the purlins in synchronism with the deposit of the panels onto the purlins. The fastening means includes a magazine containing a plurality of fastening devices such as screws or rivets, which are fed into registry with the panels to be secured and a fastening actuator means, in timed relation with the feeding of the panels and the travel of the wheeled carts. The actuator means automatically drills the fasteners through the panels and into the purlins to secure said panels thereto.

A plurality of modular wheeled carts are provided and are driven by a common drive means. Each of the wheeled carts feeds roofing panels along parallel sets of purlins. In this manner a substantial portion of the roof of a building can be completed by a single sweep of the wheeled carts, thus enabling a very high speed of operation.

BRIEF DESCRIPTION OF THE DRAWINGS

The objects of the present invention and the attendant advantages thereof will become more readily apparent by reference to the following drawings wherein:

FIGS. 5A to 5C are side views in section of the roof panel fastening means illustrating the sequence of operation thereof;

FIG. 5D is a top plan view of the device of FIGS. 5A to 5C;

FIG. 6A is a perspective view of a fastener supporting chamber of the fastening means of FIGS. 5A to 5C;

FIG. 6B is a sectional view taken along line 6B-6B of FIG. 6A.

DETAILED DESCRIPTION OF DRAWINGS

Referring in detail to FIGS. 1 to 4 of the drawings there is illustrated a plurality of wheeled carriages or carts generally designated 10. Each wheeled cart includes a substantially U-shaped frame 12 which is closed at the top and opened at the bottom. Frames 12 are provided at the fore and aft ends on the bottoms thereof with a pair of wheels or rollers 14A, 14B which engage above and below, respectively, with the top surface of roof purlins 16. These wheels are journaled for rotation in the lower ends of U-shaped frame 12.

Figure 1:
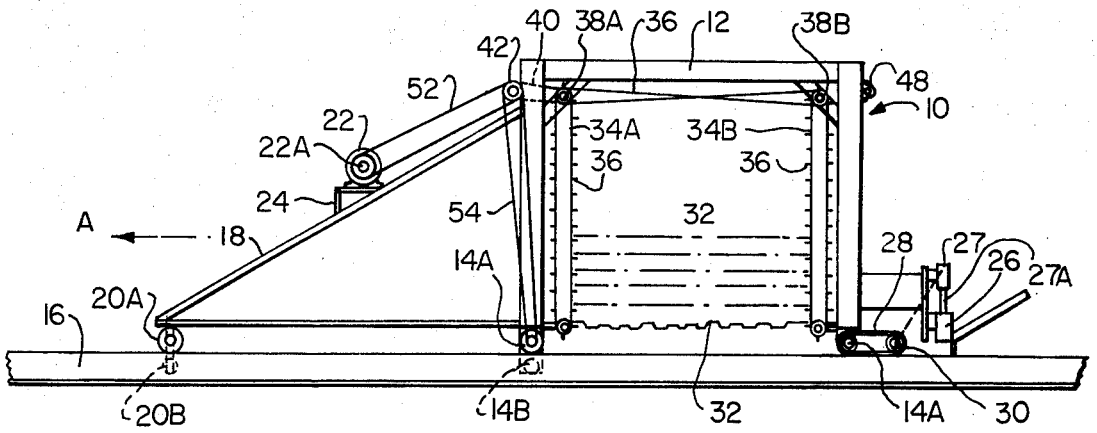
FIG. 1 is a side elevational view illustrating the wheeled carts of the present invention.
Figure 3:
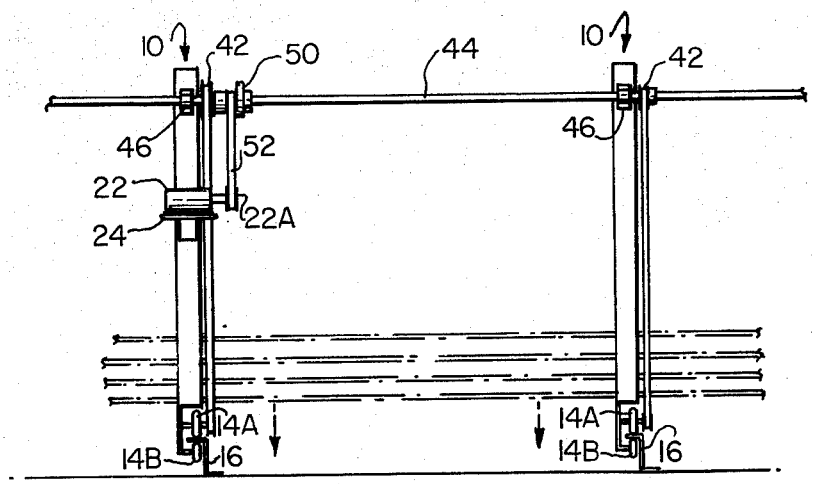
FIG. 3 is a partial end view of the wheeled carts of FIG. 3.

Carts 10 further include at the fore end triangular shaped frames 18 welded or suitably secured to frames 12. Frames 18 are provided at one apex thereof with an additional pair of wheels or rollers 20A, 20B which also engage with the upper and lower surfaces, respectively, of purlins 16. Triangular frame 18 enhances the stability of carts 10 and in addition, at least one of said frames 18 functions as a support for a drive motor 22. As illustrated in FIGS. 1 and 3 a bracket 24 is provided on frame 18 for motor 22.

Carts 10 further include at the aft ends a fastening means generally designated 26 to be described in more detail hereinafter by reference to FIGS. 5A, 5B, 5C, 6A and 6B. A belt 28 is provided between rear wheel 14A of each of carts 10 and a cam timer wheel 30. Cam timer wheel 30 controls the operation of fastener means 26 in synchronism with the travel of Carts 10 along purlins 16, thus in synchronism with the rotation of rear wheel 14A. Belt 28 is flexible and will conform to the peaks and valleys on the surface of roofing panels 32 as it rolls over said panels.

Cam timer wheel 30 may be of any suitable type. For example wheel 30 may have a nub or cam surface thereon which actuates an ON switch on fastener means 26 after a predetermined number of revolutions of rear wheel 14A of carts 10. Of course the size of wheels 14A with respect to the size of roofing panels 32 must be considered when choosing or determining the design of cam timer 30.

Figure 2:
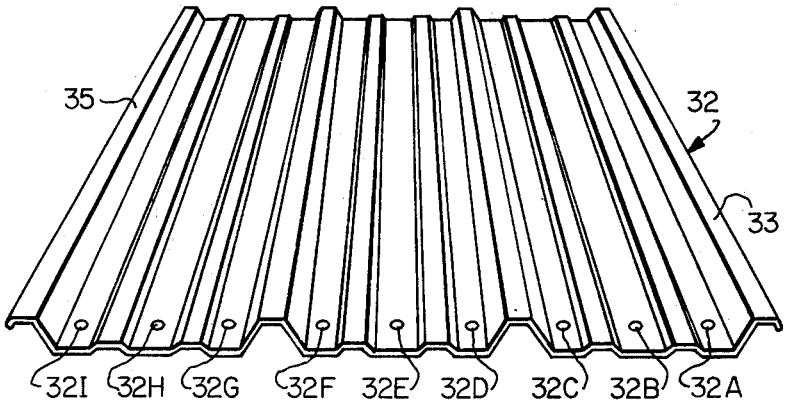
FIG. 2 is a perspective view of a roofing panel suitable for use with the wheeled cart of FIG. 1.

For example, referring specifically to FIG. 2 there is illustrated a typical roof panel 32. It may be desired to apply a fastener through roof panel 32 into purlins 16 at positions 32A to 32I which are substantially equally spaced. Accordingly, the size of the wheel of cam timer 30 and the position of a nub or cam surface thereon would be selected in accordance with the distance between points such as 32A and 32B. In other words timer wheel 30 would be designed so that one revolution thereof corresponds to the displacement of fastener device 26 a distance equal to that between points 32A, 32B. With no nub or cam surface on timer wheel 30 fastener device 26 would be actuated each time said distance was traversed.

The above is offered only by way of example. It should be understood that other types of synchronous timing arrangements could be provided without departing from the spirit and scope of the present invention.

With still further reference to FIG. 1 there are provided within each of carts 10 a pair of belts 34A, 34B having a plurality of equally spaced projections 36 thereon which support one above the other roof panels 32. Belt 34A is mounted for rotation in a clockwise direction inside frame 12 and belt 34B is mounted for counter clockwise rotation inside frame 12. Belts 34A, 34B are driven in synchronism by belt 36 which engages with pulleys 38A, 38B. Pulley 38A is a double pulley having one wheel for receiving belt 36 and a second wheel for receiving a belt 40. Belt 40 is coupled to a drive wheel 42 on a main drive shaft 44.

In a preferred embodiment drive shaft 44 may comprise a plurality of sections which are screwed together and journaled for rotation in bearings 46 of frames 12. In this manner drive shaft 44 functions both as a support for holding carts 10 together and as a common drive shaft for all of carts 10. A similar type of sectional shaft 48 exclusive of a drive means may be provided at the aft ends of frames 12 for supporting said aft ends of carts 10 in parallel. It can be readily seen that the carts 10 are releasably connected by shafts 44 and 48 and, therefore, any number of carts can be connected together, as desired. See for example FIG. 4 which illustrates five of such carts 10 connected together for traversing a set of five parallel roof purlins simultaneously.

A drive pulley 50 is provided on drive shaft 44 for connection to drive motor 22 via belt 52 and pulley 22A. Thus rotary motion is imparted to drive shaft 44 by motor 22 which rotates main drive pulleys 42 on each of carts 10 and rotates belts 34A, 34B in the directions hereinbefore described. As belts 34A, 34B rotate, roof panels 32 are deposited one at a time onto purlins 16 as the carts 10 move longitudinally of the purlins 16. The relative sizes of pulleys 38A, 38B, 42, 22A, 50 and the spacing of projections 36 on belts 34A, 34B are so chosen and designed to drive belts 34A, 34B at a predetermined speed which will facilitate the deposit of the panels 32 so that the ends of each contiguous panel will overlap.

For example, referring to FIG. 2 panel 32 has a front edge 35 and a rear edge 33. As carts 10 travel in the direction A indicated in FIG. 1 one panel 32 at a time will be deposited onto purlins 16 and automatically secured by fastener means 26. The deposit of panels is so timed that the rear edge 33 of the second panel will be deposited in overlapping relation with the front edge 35 of the first panel and so on with the remaining panels in seriatim.

Drive pulleys 42 of each of carts 10 are also coupled to front wheels 14A. It is by this means that carts 10 are driven along purlins 16 in the direction A shown in FIG. 1.

Motor 22 may be any suitable type of rotary drive means such as an electric motor or a fluidic type. In a preferred embodiment motor 22 is a conventional type of pneumatic motor drive from a compressor located on the ground adjacent the building being constructed.

Figure 4:
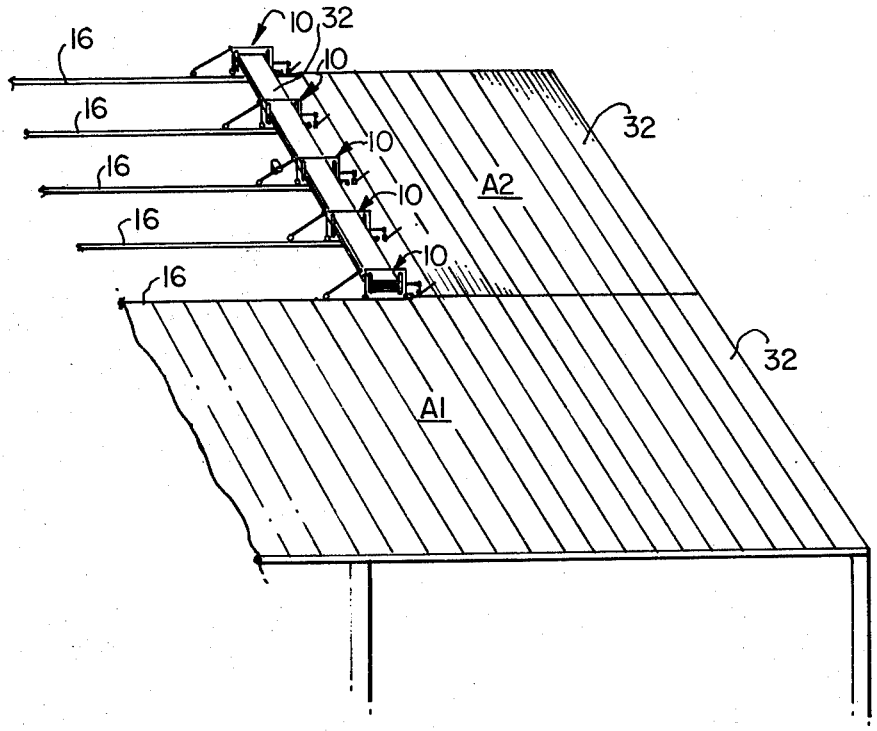
FIG. 4 is a diagramatic view of the wheeled carts of the present invention illustrating the application of roofing panels.

The general operation of the automatic roofing machine of the present invention is illustrated in FIG. 4. Area, A1, represents a section of the roof on which panels 32 have already been applied, which area, A2, represents a roof section in the process of being covered. As can be seen the roofing panels 32 extend the entire length of the composite construction of five carts 10 and are deposited one at a time, with the edges overlapping as described hereinbefore, as carts 10 travel along purlins 16. The roofing panels are automatically secured by fastening means 26 to purlins 16 in synchronism with the travel of carts 10.

Referring in detail to FIGS. 5A, 5B, 5C, 6A and 6B there is illustrated the details of operation of the fastener means of FIG. 1 generally indicated 26. This fastener means is described primarily for use with the automatic roofing machine of the FIGS. 1 to 4. However, it should be understood that fastening means 26 could be used separately as a hand held device for securing sheet material to any type of surface.

Fastener means 26 is provided with a main body 60 which is coupled to a screw gun 65 shown diagramatically in dotted lines. The main body 60 includes a main cylindrical sleeve 62 in which a drive shank 64 is disposed for rotation. Drive shank 64 has a hexagonal slot 64A at the bottom thereof for receiving the hexagonal head of a screw 66. The upper end of cylindrical sleeve 62 is threaded on its inner surface for receiving an actuator device such as an electric or pneumatic screw gun 65. The entire screw gun 65 in the machine of FIG. 1 is mounted for reciprocal movement in a direction longitudinally of drive shank 64 in order to depress both drive shank 64 and cylindrical sleeve 62 toward the roof panel to be fastened. This reciprocal movement may be imparted by a pneumatic cylinder and piston arrangement indicated diagramatically as 27 and 27A respectively, in FIG. 1. Piston 27A may be coupled by any suitable means to screw gun 65.

Of course, as stated hereinbefore, the screw gun could be manually operated and, therefore, manually depressed toward the sheet material being fastened by the operator thereof.

Fastener device 26 is provided with spring loaded telescopic sleeves 68 and 70 on the sides of cylindrical sleeve 62.

Spring loaded sleeve 68 has an upper section 68A which is rigidly affixed to sleeve 62 by welding or other suitable means and a lower section 68B which slides within section 68A. Section 68B is rigidly affixed to an additional cylindrical sleeve 72 to be further described hereinafter with reference to FIGS. 6A and 6B. A spring 68S is provided to urge sections 68A and 68B apart toward the position indicated in FIG. 5A. Stop means (not shown) are provided to prevent section 68B from sliding completely out of section 68A.

Spring loaded sleeve 70 likewise has a top section 70A rigidly secured to cylindrical sleeve 62 and a bottom section 70B which is slidably received in section 70A. Section 70B is rigidly affixed to a screw magazine 80 to be described hereinafter and is adapted for movement therewith. As will be described magazine 80 is mounted for slidable movement on cylindrical sleeve 72. A spring 70S is provided in telescopic sleeve 70 and, as is shown in FIG. 5A, is of a length shorter than the fully extended lengths of sections 70A, 70B, for reasons which will become more fully apparent with reference to the description of operation to follow. As in sleeve 68, stop means are provided to keep the tubular sections from separating.

As illustrated in FIG. 5D, which is a top plan view of the fastening device of FIGS. 5A to 5C, telescopic sleeves 68, 70 have a substantially semicircular cross section.

A spring loaded magazine 80 is provided for containing a plurality of screws 66 of the self tapping or self drilling type. Magazines of this type are well known in the art and include a pusher element 82 slidably mounted on tracks or rods 84. Magazine 80 is slotted at the bottom for receiving a row of screws 66. A spring 86 is provided for pushing pusher element 82 against screws 66 for ejecting the screws one at a time from magazine 80 into sleeve 72 in alignment with slot 64A.

As shown in FIG. 6A sleeve 72 has an opening 72C therein through which screws 66 are fed and a pair of spring like fingers 72D, 72F (see FIG. 6B) on which the flanges 66A of screws 66 may rest. Sleeve 72 is further provided with a pair of rails 72A, 72B on which magazine 80 is slidably mounted at its lower end. Magazine 80 is provided at said end with a pair of slots (not shown) which engage with rails 72A, 72B.

Also on the lower end of magazine 80 is a work engaging pusher rod 90 which rests on the panel or sheet material to be fastened and holds said material firmly in place during fastening.

The operation of fastener rdevice 26 can be illustrated by reference to FIGS. 5A to 5C. In the initial position illustrated in FIG. 54 one screw 66 is disposed in chamber or sleeve 72 and rests on spring like fingers 72D, 72E. In this initial position drive shank 64 and cylindrical sleeve 62 are in the retracted positions shown.

To begin the fastening operation shank 64 and sleeve 62 are simultaneously depressed bringing screw head 66B into registry with slot 64A and driving the end of screw 66 through panel 32, as illustrated in FIG. 5B. In the position indicated in FIG. 5B telescopic sleeves 68 and 70 are compressed as shown and the top end of sleeve 72 abuts the lower end of sleeve 62.

Drive shank 64 is then rotated by the screw gun not shown to draw the screw head toward panel 32 as indicated in FIG. 5C. As screw head 66B is drawn against panel 32 rod 90 raises magazine 80 upwardly along tracks 72A, 72B whereby the opened lower end of magazine 80 is no longer in registry with opening 72C in sleeve 72. Thus the screws 66 remaining in magazine 80 are precluded from entering sleeve 72 until fastener device 26 resumes the initial position indicated in FIG. 5A. When this occurs the next screw is injected into sleeve 66 for insertion into panel 32 upon command.

It should be understood that the apparatus described herein may be modified as would occur to one of ordinary skill in the art without departing from the spirit and scope of the present invention.

It is claimed:

1. An apparatus for automatically applying and securing roofing panels to the roof of a building comprising:

cart means for storing a supply of said roofing panels;

drive means for moving said cart means in a predetermined direction across said roof;

fastening means for automatically securing said roofing panels to said roof;

control means for actuating said fastening means in synchronism with the deposit of said roofing panels on said roof;

a pair of spaced conveyor means included within said cart means;

projection means on each of said conveyor means for supporting a stack of said roofing panels substantially in parallel with respect to each other in the space between said conveyor means; and means coupling said conveyor means to said drive means to drive said conveyor means and sequentially deposit said roofing panels in synchronism with the movement of said cart means.

2. The apparatus of claim 1 wherein said cart means comprises at least two carts releasably coupled together and said roof includes at least two parallel purlins, each of said carts having wheels for rolling engagement with said purlins.

3. The apparatus of claim 2 wherein at least one of said wheels is a drive wheel, said drive wheel being coupled to said drive means, said drive means including a common drive motor for all of said carts.

4. The apparatus of claim 1 wherein said conveyor means sequentially deposits said roofing panels on said roof with the ends of adjacent panels in overlapping relation.

5. The apparatus of claim 1 wherein each of said conveyor means comprises an endless belt disposed in a plane substantially perpendicular to the plane of said roof, and said projection means are disposed on said endless belts.

6. An apparatus for automatically applying and securing roofing panels to the roof of a building comprising:

cart means for storing a supply of said roofing panels;

drive means for moving said cart means in a predetermined direction across said roof;

means for sequentially depositing roofing panels onto said roof as said cart means is moved in said predetermined directions;

magazine means for storing a plurality of screws and feeding said screws in seriatim in alignment with a deposited panel;

sleeve means having an opening therein for receiving screws in seriatim from said magazine with said magazine in a first predetermined position, said sleeve means including means for supporting one screw at a time in alignment with said deposited panel;

drive shank means disposed within said sleeve means, said drive shank means including a slot for receiving a head of said screw in said sleeve means;

means for linearily displacing both said sleeve means and said drive shank means toward said deposited panel in response to a control signal from said control means;

means for rotating said drive shank for drawing said head of said screw in said sleeve means against said deposited panel; and means for moving said magazine away from said first predetermined position and longitudinally with respect to said sleeve means in response to the drawing of said head against said deposited panel to thereby preclude the passage of screws from said magazine through said opening in said sleeve means.

7. The apparatus of claim 6 wherein said means for moving said magazine comprises push rod means coupled to said magazine which pushes against said deposited panel as said screw head is drawn thereto and slide means on said sleeve means on which said magazine is mounted for reciprocal movement, said push rod means lifting said magazine along said slide means in response to said drawing of said screw head against said deposited panel.

* * * * *